US011330927B2

(12) United States Patent
Loures et al.

(10) Patent No.: US 11,330,927 B2
(45) Date of Patent: May 17, 2022

(54) PACKAGE RECEPTACLE AND THEFT DETERRENT DEVICE AND SYSTEM

(71) Applicants: James Loures, Avon-by-the-Sea, NJ (US); Christine Suarez-Loures, Avon-by-the-Sea, NJ (US)

(72) Inventors: James Loures, Avon-by-the-Sea, NJ (US); Christine Suarez-Loures, Avon-by-the-Sea, NJ (US)

( * ) Notice: Subject to any disclaimer, the term of this patent is extended or adjusted under 35 U.S.C. 154(b) by 0 days.

(21) Appl. No.: 16/867,938

(22) Filed: May 6, 2020

(65) Prior Publication Data

US 2020/0260897 A1 Aug. 20, 2020

Related U.S. Application Data

(63) Continuation of application No. 16/156,106, filed on Oct. 10, 2018, now Pat. No. 10,653,261.

(60) Provisional application No. 62/570,130, filed on Oct. 10, 2017.

(51) Int. Cl.

| | |
|---|---|
| ***A47G 29/20*** | (2006.01) |
| ***E05B 67/38*** | (2006.01) |
| ***E05B 73/00*** | (2006.01) |
| ***E05B 65/52*** | (2006.01) |

(52) U.S. Cl.

CPC ..... *A47G 29/20* (2013.01); *E05B 65/52* (2013.01); *E05B 67/383* (2013.01); *E05B 73/00* (2013.01)

(58) Field of Classification Search

CPC ..... A47G 29/20; E05B 65/52; E05B 67/383; E05B 75/00

USPC ..... 383/38

See application file for complete search history.

(56) References Cited

U.S. PATENT DOCUMENTS

| | | | | |
|---|---|---|---|---|
| 2,577,670 | A * | 12/1951 | Adams | A45C 3/00 190/111 |
| 5,624,071 | A | 4/1997 | Sosan | |
| 6,026,662 | A * | 2/2000 | Schlipper | A45C 3/001 70/18 |
| 6,155,715 | A | 12/2000 | Lake et al. | |
| 10,653,261 | B2 * | 5/2020 | Loures | E05B 67/383 |
| 2002/0148395 | A1 | 10/2002 | Judge | |
| 2004/0022455 | A1 | 2/2004 | Reason | |
| 2005/0175441 | A1 * | 8/2005 | Liberman | G06Q 10/08 414/807 |
| 2006/0016532 | A1 * | 1/2006 | Volk | A45C 13/18 150/102 |
| 2011/0214787 | A1 * | 9/2011 | Schulte | A45C 13/26 150/102 |
| 2012/0125494 | A1 * | 5/2012 | Avganim | E05B 73/0082 150/101 |
| 2012/0269461 | A1 | 10/2012 | Proctor et al. | |
| 2013/0077896 | A1 | 3/2013 | Wiley et al. | |
| 2015/0305538 | A1 | 10/2015 | Sundaresan | |
| 2017/0055751 | A1 | 3/2017 | Sundaresan | |

(Continued)

OTHER PUBLICATIONS

International Search Report (PCT/ISA/210) and Written Opinion dated Jan. 2, 2019 for International Application No. PCT/US2018/055179.

*Primary Examiner* — Jes F Pascua

(57) ABSTRACT

An improved package receptacle and theft deterrent device, in which a flexible receiving bag constructed of a rugged material includes security features to restrict access to its internal chamber and may be removably attached to a door or other structure through fully-removable or partially permanently attached means.

18 Claims, 11 Drawing Sheets

(56) References Cited

U.S. PATENT DOCUMENTS

| | | | | |
|---|---|---|---|---|
| 2018/0202199 | A1* | 7/2018 | Critz | B65D 33/34 |
| 2020/0060460 | A1* | 2/2020 | Farrar | A47G 29/141 |

* cited by examiner

PACKAGE RECEPTACLE AND THEFT DETERRENT DEVICE AND SYSTEM

CROSS-REFERENCE TO RELATED APPLICATIONS

This application is a continuation of U.S. Utility application Ser. No. 16/156,106, filed on Oct. 10, 2018, which claims priority to U.S. Provisional Application 62/570,130, filed on Oct. 10, 2017, both of which are incorporated herein in their entirety.

FIELD OF THE INVENTION

The invention relates to improvements to theft deterrent devices, in particular deterrence of theft from receptacles used for storing items delivered by one party or carrier and intended for receipt by another party or carrier.

BACKGROUND OF THE INVENTION

With the rise of online retailers and the corresponding decline of brick-and-mortar stores, the shopping experience frequently culminates in a package being delivered to a customer, rather than being brought home from a physical point-of-sale location. However, the recipient is not always present when the package is delivered, and thus the carrier must either bring the package back to a central warehouse for later pickup by the recipient or leave the package unattended at the delivery address. In the case of the former, this can lead to unintended delays in receipt, as the customer may not be able to travel to the central warehouse for pickup during normal business hours. In the case of the latter, unattended packages become prime candidates for theft; this is particularly problematic in urban areas, where greater traffic near the delivery address increases the number of individuals who see the unattended package.

Anecdotal evidence shows that some delivery services will go to significant lengths to hide packages from potential thieves. However, this is not the norm. Every moment spent attempting to hide a package for one customer is a moment that the carrier no longer has available to deliver packages to subsequent recipients on that day's route. Accordingly, while going to such lengths is admirable from a customer-service perspective, as such extra time accumulates throughout the day, it has the potential to result in later packages not being delivered on time, if at all. Conversely, it may require the delivery person to work overtime or to make up for lost time by driving at unsafe speeds or engaging in other traffic violations in order to meet the delivery quota for the day.

Some attempts at remedying the problem of package theft involve the permanent installation of large mailboxes or other unsightly structures. In addition to aesthetic issues, permanent installations are also problematic when there are space constraints, as these structures take up the same amount of space when in use and when not in use. Further, for high-capacity delivery locations, such as apartments, there simply may not be enough space to erect or permanently mount receptacles Other removable theft-deterrent devices have been developed, including U.S. Pat. No. 6,155,715; however, these have drawbacks of their own. The device of the '715 patent includes a clamp that is used to affix a pouch to the edge of a door or to serve as an anchor placed behind the door. Affixing the anchor to the side or the top of the door requires that there be adequate clearance between the edge of the door and the door jamb; inadequate clearance will cause damage to the door jamb or prevent the door from being closed. Similarly, affixing the clamp to the bottom of the door requires adequate clearance between the door and the ground, as the clamp would be damaged or the door wouldn't move if the clamp were to come into contact with the ground. Use of the clamp as an anchor is equally problematic: there must be an adequate gap between the door and the jamb to accommodate the diameter of the cable and using the clamp as a behind-the-door-anchor may scratch or otherwise cause damage to the finished surface of the interior side of the door, jamb, or walls. Finally, when the clamp is affixed to the bottom of the door or is used as an anchor behind the bottom of the door, the pouch of the '715 patent lays on the ground in such a manner that a delivery person must bend over entirely to access the pouch and then must use two hands to close the pouch.

As a result, in light of the foregoing, it is clear that there is an unmet need in the art for a theft deterrent device that is removable and small enough to accommodate the demands of high-capacity residences, yet does not cause damage to the surrounding structures and maximizes ease of use by carriers and others delivering packages into the receptacle.

BRIEF SUMMARY OF THE INVENTION

The package receptacle device and system described herein provides an improvement upon prior systems and devices for receiving packages and deterring the theft of the same.

The improved package receptacle device described below may be manufactured in at least two versions: one utilizing a removable connection device which may be removably affixed to a home or other structure, and another version utilizing an attachment device, a portion of which is permanently affixed to a home or other structure.

Similarly, the improved package receptacle system described herein may also be manufactured in at least two versions: one utilizing a removable connection device which may be removably affixed to a home or other structure, and another version utilizing an attachment device, a portion of which is permanently affixed to a home or other structure.

Accordingly, with the benefit of the present disclosure, one skilled in the art would be able to manufacture package receptacles of varying sizes, locking, and connection capabilities, to permit for deterrence of package theft from residences and other structures in any number of circumstances.

Additional objects, advantages and novel features of the invention will be set forth in part in the description, examples and figures which follow, all of which are intended to be for illustrative purposes only, and not intended in any way to limit the invention, and in part will become apparent to those skilled in the art on examination of the following, or may be learned by practice of the invention.

BRIEF DESCRIPTION OF THE FIGURES

The foregoing summary, as well as the following detailed description of the invention, will be better understood when read in conjunction with the appended drawings. It should be understood, however, that the invention is not limited to the precise arrangements and instrumentalities shown.

DETAILED DESCRIPTION OF THE INVENTION

Although certain embodiments are depicted in the figures, the invention is not limited to the specific embodiments therein; with the benefit of the present disclosure, one skilled in the art would be enabled to tailor aspects of the invention to suit any purpose and fit within any limitations, including those due to physical space constraints.

The package receptacle is comprised of a flexible receiving bag 100 constructed of a flexible, yet secure material designed to be resistant to knives and other cutting implements. Exemplary materials include KEVLAR® and DYNEEMA®, however the present invention is not so limited, and with the benefit of the present disclosure, one skilled in the art would be enabled to construct the flexible receiving bag 100 out of any flexible materials having a similar rugged and secure nature. Additionally, in a preferred embodiment, the material used in the construction of the flexible receiving bag 100 is waterproof. Flexible receiving bag 100 has at least one internal chamber.

Figure 11:
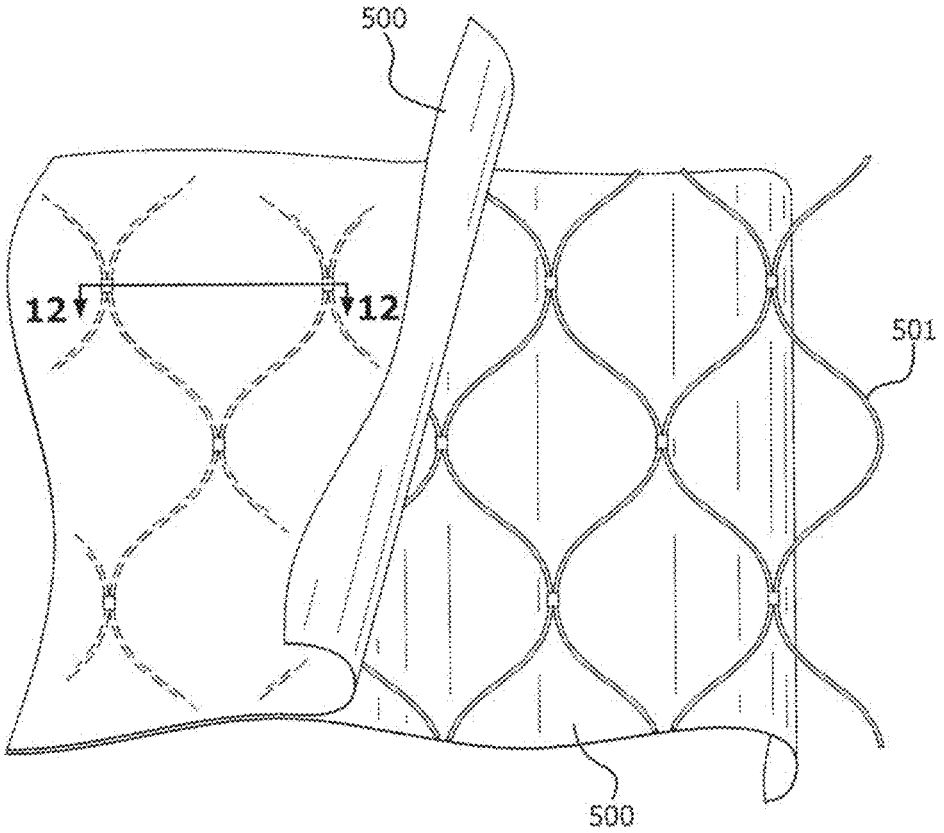
FIG. 11 shows a view of a preferred embodiment of the material used in the construction of the flexible receiving bag.
Figure 12:
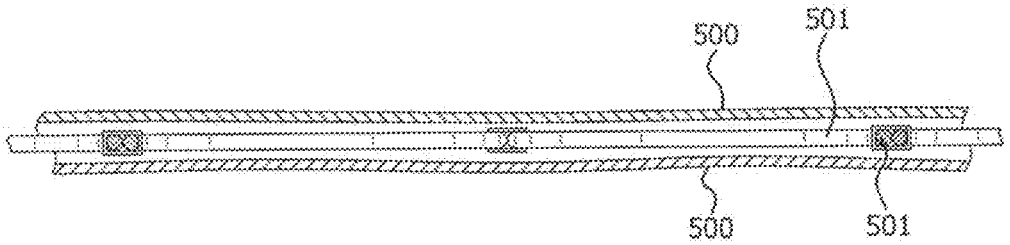
FIG. 12 shows a cross-sectional view of a preferred embodiment of the material used in the construction of the flexible receiving bag.

In one embodiment, as depicted in FIGS. 11 and 12, the material of the flexible receiving bag 100 is of a "sandwich" construction, having two layers of fabric 500, between which is a wire mesh 501, thus resulting in a fabric-mesh-fabric construction. In this embodiment, although the fabric 500 may be susceptible to cutting or other damage by knives or other implements, the wire mesh 501 is resistant to being cut or otherwise damaged, thus preventing thieves and unauthorized third parties from accessing the contents of the bag. The fabric 500 used in such a construction may be of any type known to those skilled in the art, including, but not limited to canvas, nylon, and leather. The gauge of the wire mesh 501 may be varied to provide for differing levels of security, as heavier gauge wire is resistant to a wider array of cutting implements. Similarly, the gauge of the wire mesh 501 may be varied to provide for greater flexibility in the fabric-mesh-fabric material, with heavier gauges being used to create flexible receiving bags 100 which retain a predetermined shape, and lighter gauges being used to create flexible receiving bags 100 which are more easily compressed or distorted from a basic shape. Distorting of the shape of the flexible receiving bag 100 allows for its use as a receptacle for a wider variety of shapes and sizes of packages; similarly, the more easily the flexible receiving bag 100 is distorted, the more easily it may be folded or rolled up and stored when not in use. Thus, with the benefit of the present disclosure, one skilled in the art is enabled to select the appropriate fabric 500 and gauge of wire mesh 501 to provide for a range of levels of security and compressibility.

FIGS. 11 and 12 depict an embodiment where the individual wires of wire mesh 501 are linked to one another through ties or other devices; however, the invention is not so limited. In an embodiment not shown in the figures, the individual wires of wire mesh 501 are wrapped around one another, in the style of a chain-link fence. In yet another embodiment, the individual wires of wire mesh 501 are linked to one another through a combination of ties and by wrapping around one another.

Flexible receiving bag 100 further comprises a top end 101 and a bottom end 102.

Additionally, Flexible receiving bag 100 further comprises at least one zipper mechanism 105 and at least one locking receiver 104. Flexible receiving bag 100 is configured such that the quantity of zipper mechanisms 105 matches the number of locking receivers 104.

Zipper mechanism 105 may be one of any variety of zipper mechanisms known in the art. Zipper mechanism 105 has at least two complementary, reversibly-engageable teeth elements 106 and a slider 107, with the operation of slider 107 in one direction effecting the engagement of complementary teeth elements 106 to one another and the operation of slider 107 in the opposite direction effecting the disengagement of complementary teeth elements 106. Engagement of teeth elements 106 provides for closure of flexible receiving bag 100, thereby restricting access to an internal chamber of flexible receiving bag 100, whereas disengagement of teeth elements 106 provides for access to an internal chamber of flexible receiving bag 100. Zipper mechanism 105 has a first end and a second end. When slider 107 is positioned at the first end of zipper mechanism 105, teeth elements 106 are not engaged, and the internal chamber of flexible receiving bag 100 is accessible. When slider 107 is advanced to the second end of zipper mechanism 105, teeth elements 106 are engaged, and the internal chamber of flexible receiving bag 100 is no longer accessible.

Teeth elements 106 each have a plurality of teeth and are constructed to have a high number of teeth per inch and extremely tight tolerances. In a preferred embodiment, the teeth of teeth elements 106 are angled, such that when they are complementarily, reversibly engaged with the teeth of another teeth element 106, there is little to no gap between the teeth of one teeth element 106 and the teeth of the other teeth element 106; in this way the reversibly-engageable teeth elements 106 are less susceptible to being pried apart by a knife, screwdriver, or other implement. In one embodiment, the teeth elements 106 are in a single-coil form, such form being known in the art. In a preferred embodiment, the teeth elements 106 are in double-coil form, such form being known in the art; in this embodiment, the double-coil form provides for increased security, as the teeth elements 106 are less prone to being forced apart by pressure or sharp objects applied directly to them when the two teeth elements 106 are engaged with one another.

Slider 107 has a body 109 and a pull 108. In one embodiment, as depicted in FIGS. 1-4, the construction of slider 107 is such that body 109 and pull 108 are integral to one another. In an alternate embodiment, not depicted in the figures, body 109 and pull 108 are linked by a crown or other device, as is known in the art.

In one embodiment, zipper mechanism 105 further comprises at least two reversibly-engageable top stops.

Zipper mechanism 105 may be constructed of any rugged material, including metals or alloys. In one embodiment, all parts of zipper mechanism 105 are constructed of the same material. In an alternate embodiment, the materials used to construct the parts of zipper mechanism 105 vary from part to part. In a preferred embodiment, at least one part of zipper mechanism 105 is constructed of nickel.

Locking receiver 104 is located adjacent to the second end of zipper mechanism 105, and is configured to reversibly engage at least a portion of slider 107.

Figure 2:
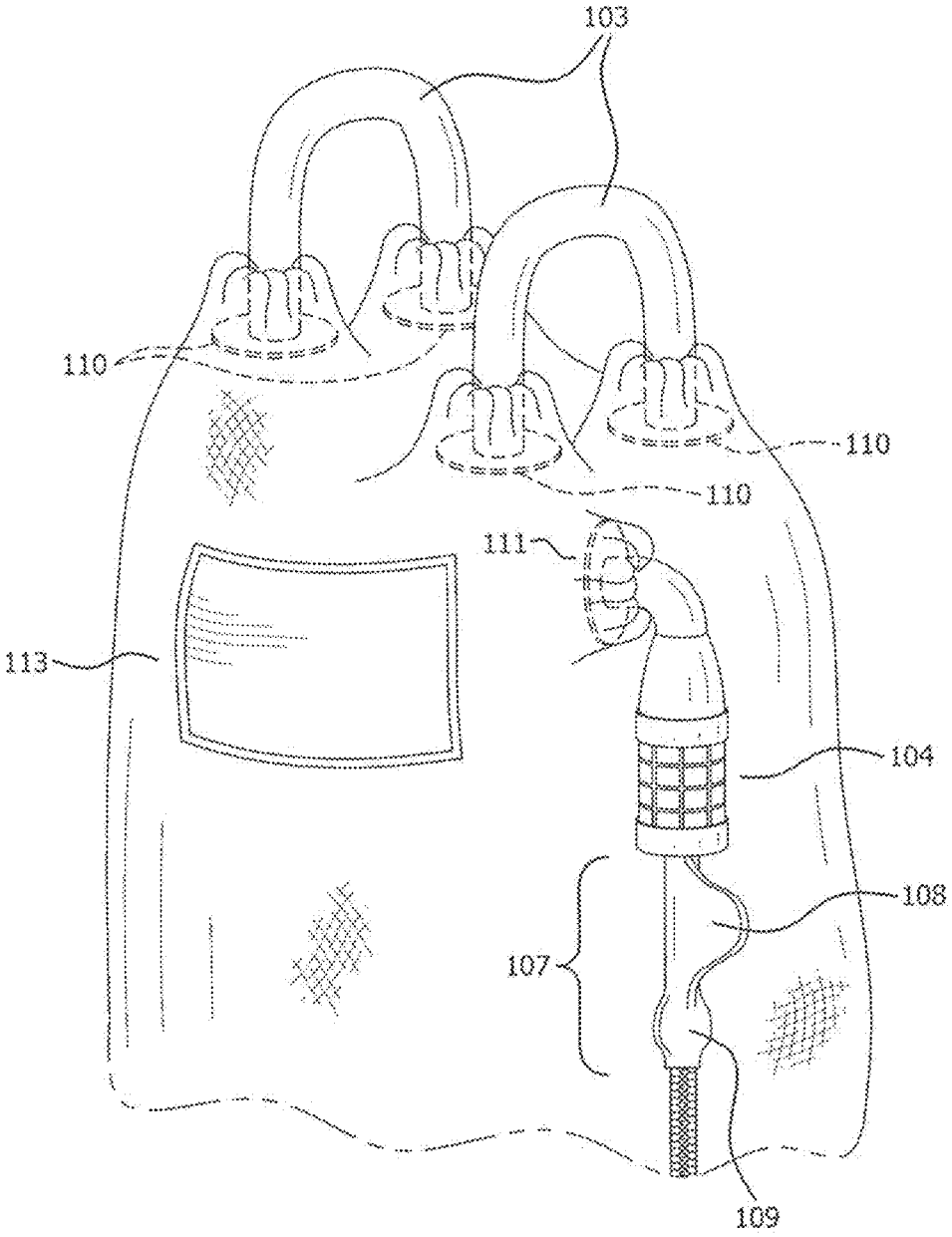
Figure 3:
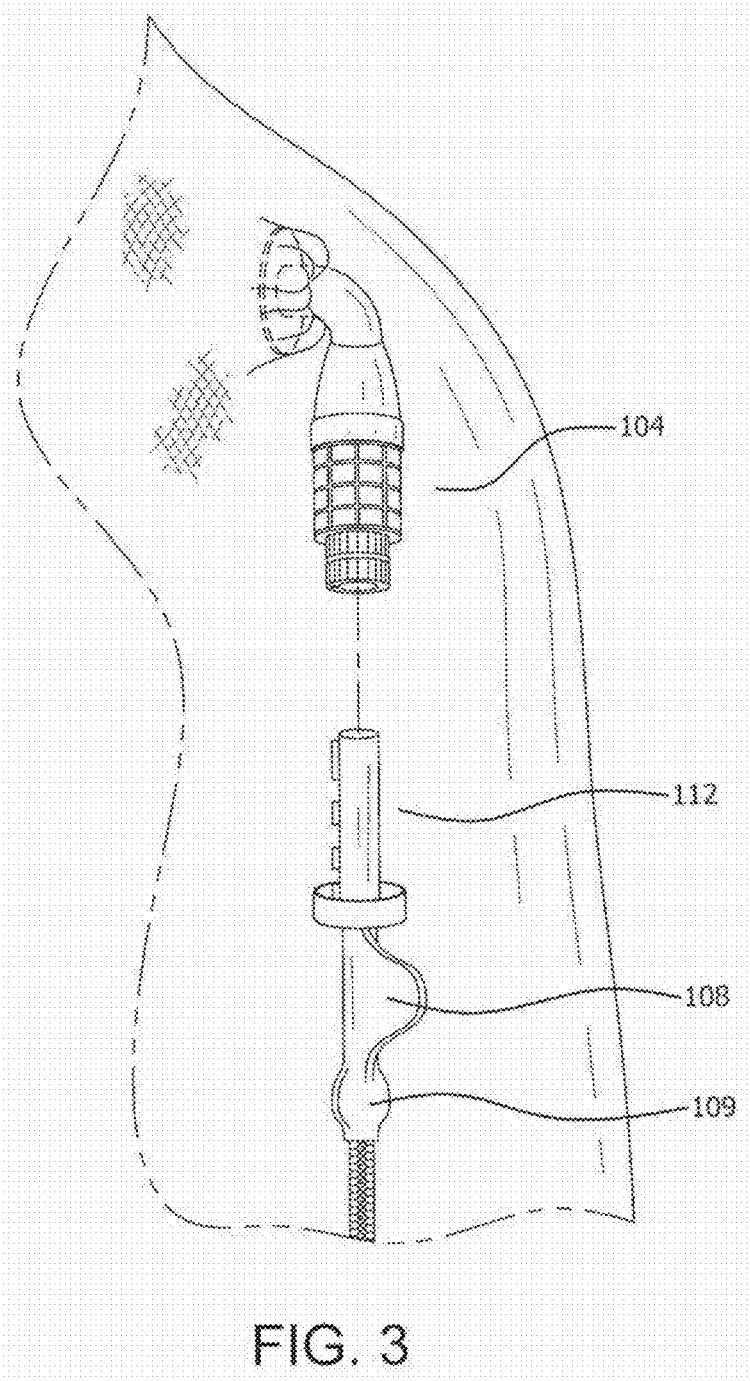
FIG. 3 shows a close-up view of one embodiment of the relationship between the flexible receiving bag, the locking receiver, and the zipper mechanism.

Locking receiver 104 has an attachment element, a locking element, and a receiving element. The attachment element of locking receiver 104 extends into flexible receiving bag 100 and terminates at an anchor element 111; anchor element 111 prevents locking receiver 104 from being removed from flexible receiving bag 104. In one embodiment, as shown in FIGS. 2-3, anchor element 111 is a disc, however the invention is not so limited, and with the benefit of the present disclosure, one skilled in the art would be enabled to design anchor element 111 as any shape or structure suitable for such purposes, including but not limited to, balls and rings. In a preferred embodiment, the material used in the construction of flexible receiving bag 100 is woven around anchor element 111. In one embodiment, grommets or other means known in the art protect the material of flexible receiving bag 100 from fraying at the locations where locking receiver 104 passes through flexible receiving bag 100.

The locking element of locking receiver 104 is one of any number of locks known to those having skill in the art. In one embodiment, the locking element utilizes a key to lock and unlock locking receiver 104. In an alternate embodiment, the locking element utilizes a combination to lock and unlock locking receiver 104. The locking element may contain any locking structures known to those in the art for releasably locking a portion of slider 107 in place. The locking element may contain any number of tumblers, and with the benefit of the present disclosure, one having ordinary skill in the art would be enabled to determine whether one, two, three, four, five, or more tumblers would be appropriate for the size and purpose of the bag.

The receiving element of locking receiver 104 is configured to engage any portion of slider 107 in a releasable manner, including by insertion of the portion of slider 107 into locking receiver 104 or by rotation of a portion of locking receiver 104 to secure a portion of slider 107 in place, or by any other means known in the art. Such methods include, but are not limited to, the receiving element having a stationary lower portion and movable upper portion, wherein the movable upper portion surrounds the portion of slider 107 when receiver is locked in place, and can be rotated away from the portion of slider 107, thus releasing the portion of slider 107, upon unlocking of locking receiver 104.

In one embodiment, as shown in FIG. 3, slider 107 further comprises a keyed element 112 for engagement by locking receiver 104.

In another embodiment, locking receiver 104 engages pull 108.

In another embodiment, locking receiver engages body 109.

In another embodiment, locking receiver engages a crown of slider 107.

In one embodiment, flexible receiving bag 100 has only one internal chamber, said chamber being defined by an internal surface of flexible receiving bag 100 and an internal surface of zipper mechanism 105.

In an alternate embodiment, the interior of the bag is divided into at least two internal two chambers by divider 114; divider 114 may be constructed of the same material as flexible receiving bag 100 or by any other material that provides the same protective properties as the material of flexible receiving bag 100. In a preferred embodiment of the invention wherein flexible receiving bag 100 has at least two internal chambers, divider 114 has an accordion-like shape with folds designed to permit for expansion of one internal chamber such that it intrudes upon the footprint and interior volume of the other internal chamber. In this way, large items may be inserted into one internal chamber, and the accordion-like folds of divider 114 will expand to accommodate the object. In an alternate embodiment of the invention wherein flexible receiving bag 100 has at least two internal chambers, divider 114 does not have an accordion-like shape with folds, but instead, is of a straight construction. In yet another embodiment of the invention wherein the flexible receiving bag 100 has at least two internal chambers, divider 114 is constructed of a rigid material. Flexible receiving bag 100 is constructed such that each internal chamber is accessible via its own zipper mechanism 105.

Flexible receiving bag 100 may optionally have at least one storage pouch 115. Storage pouch 115 is configured to accept deliveries and is sealed by a zipper mechanism 105 and locking receiver 104 in the same way that the internal chambers of flexible receiving bag 100 are sealed as described above. In one embodiment, storage pouch 115 is created by affixing material to the exterior of flexible receiving bag 100; in an alternate embodiment, storage pouch 115 is created by affixing material to the interior of flexible receiving bag 100.

Flexible receiving bag 100 may also optionally have at least one identification pouch 113 into which a user may insert materials identifying flexible receiving bag 100 as being their property, serving to reiterate the delivery address, or for any other purpose.

Flexible receiving bag 100 may be constructed such that locking receiver 104 and the second end of zipper mechanism 105 are located proximal to top end 101 and first end of zipper mechanism 105 is located proximal to bottom end 102; in such a conformation, closing of the internal chamber or storage pouch is effectuated by the movement of slider 107 in the direction proceeding from bottom end 102 to top end 101. In an alternate embodiment, locking receiver 104 and the second end of zipper mechanism 105 are located proximal to bottom end 102 and the first end of zipper mechanism 105 is located proximal to top end 101; in this conformation, closing of the internal chamber of storage pouch is effectuated by the movement of slider 107 in the direction proceeding from top end 101 to bottom end 102. In yet another embodiment, locking receiver 104, and the first and second ends of zipper mechanism 105 are situated such that the movement of slider 107 to effectuate closure of the internal chamber or storage pouch is perpendicular or oriented in an acute or obtuse angular relationship to the direction along which one would proceed when advancing from bottom end 102 to top end 101. In one embodiment of the invention, all internal chambers and storage pouches are closed by advancing each respective sliders 107 in the same relative direction. In another embodiment of the invention, internal chambers and storage pouches are closed by advancing their respective sliders 107 in a mixture of directions.

With the benefit of the present disclosure, one skilled in the art would be enabled to manufacture flexible receiving bag 100 with any number of internal chambers, storage pouches, and identification pouches.

Fully Removable Form

In one set of embodiments, the invention attaches to, and is fully removable from, a door or other structure. In such embodiments, the invention further comprises a removable connection device 200, which provides removable attachment to a door or other structure.

In such embodiments, flexible receiving bag 100 further comprises at least one retaining mechanism 103, configured to attach to removable connection device 200. Each retaining mechanism 103 extends into the flexible receiving bag and terminates at a terminal feature 110, as shown in FIG. 2. Terminal feature 110 is designed and structured to prevent the removal of retaining mechanism 103 from flexible receiving bag 100. In a preferred embodiment, retaining mechanism 103 is u-shaped, with the curve of the shape being outside the bag and the prongs of the shape extending into the bag, and terminal feature 110 being a disc. In another embodiment, retaining mechanism 103 has a circular or ring-like shape, which penetrates flexible receiving bag 100 at two points, with terminal feature 110 being the portion of the circular or ring-like shape inside flexible receiving bag 100.

Retaining mechanism 103 is constructed of a material resistant to being cut or broken, such material including but not being limited to metal.

In one embodiment, grommets or other means known in the art protect the material of flexible receiving bag 100 from fraying at the locations where retaining mechanisms 103 pass through flexible receiving bag 100. In an alternate embodiment, the material used in the construction of flexible receiving bag 100 is woven around retaining mechanism 103. In yet another embodiment, a separate material is wrapped around retaining mechanisms 103 and then stitched into the material of flexible receiving bag 100.

In one embodiment, retaining mechanism 103 is coated in a substance designed to reduce the likelihood of retaining mechanism 103 scratching or otherwise damaging the door or other structure to which the invention is attached.

Figure 5:
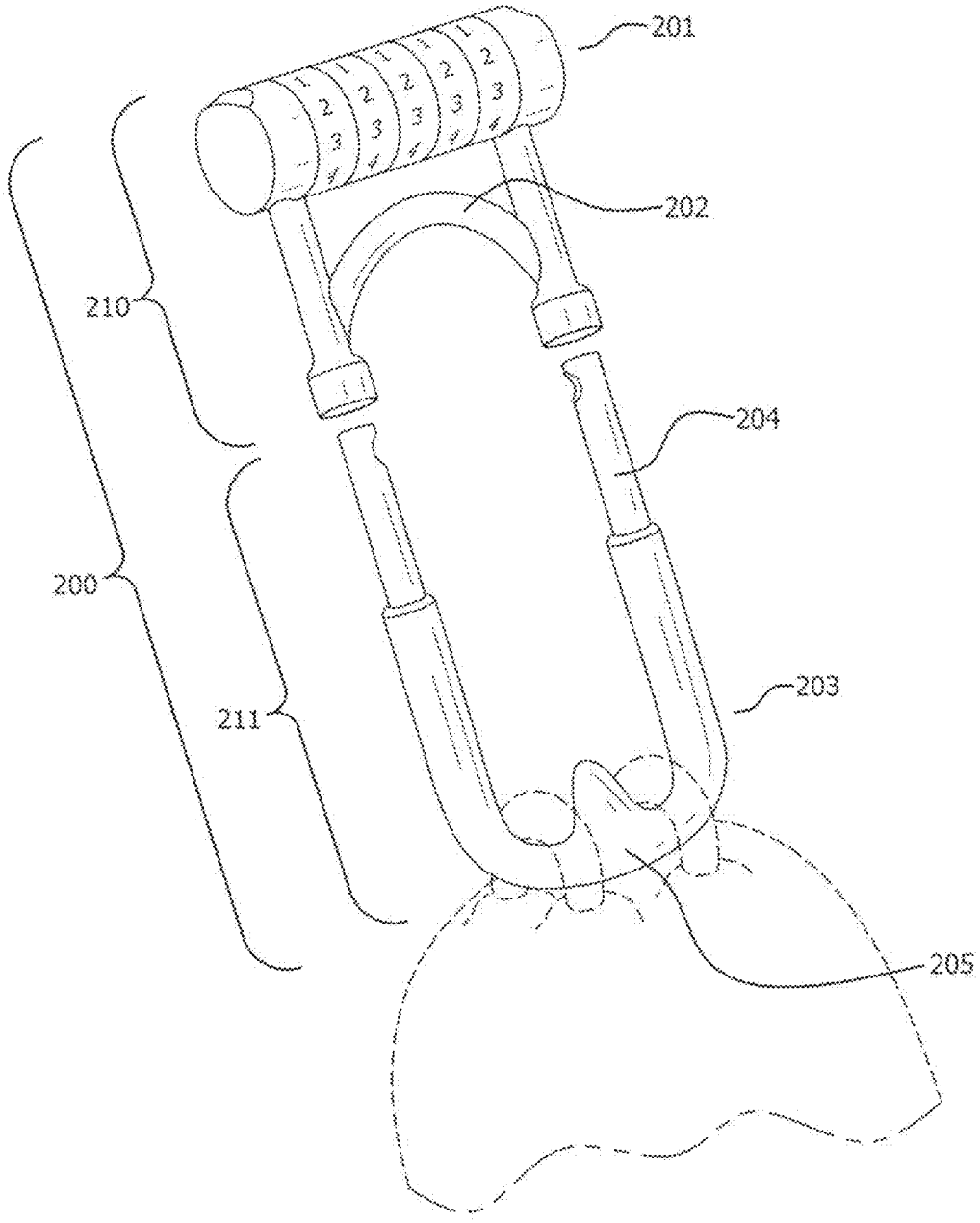
FIG. 5 shows one embodiment of the removable connection device in which the locking element and support element are located on an upper portion of the removable connection device, while the bridge piece is located on a lower portion of the removable connection device.
Figure 6:
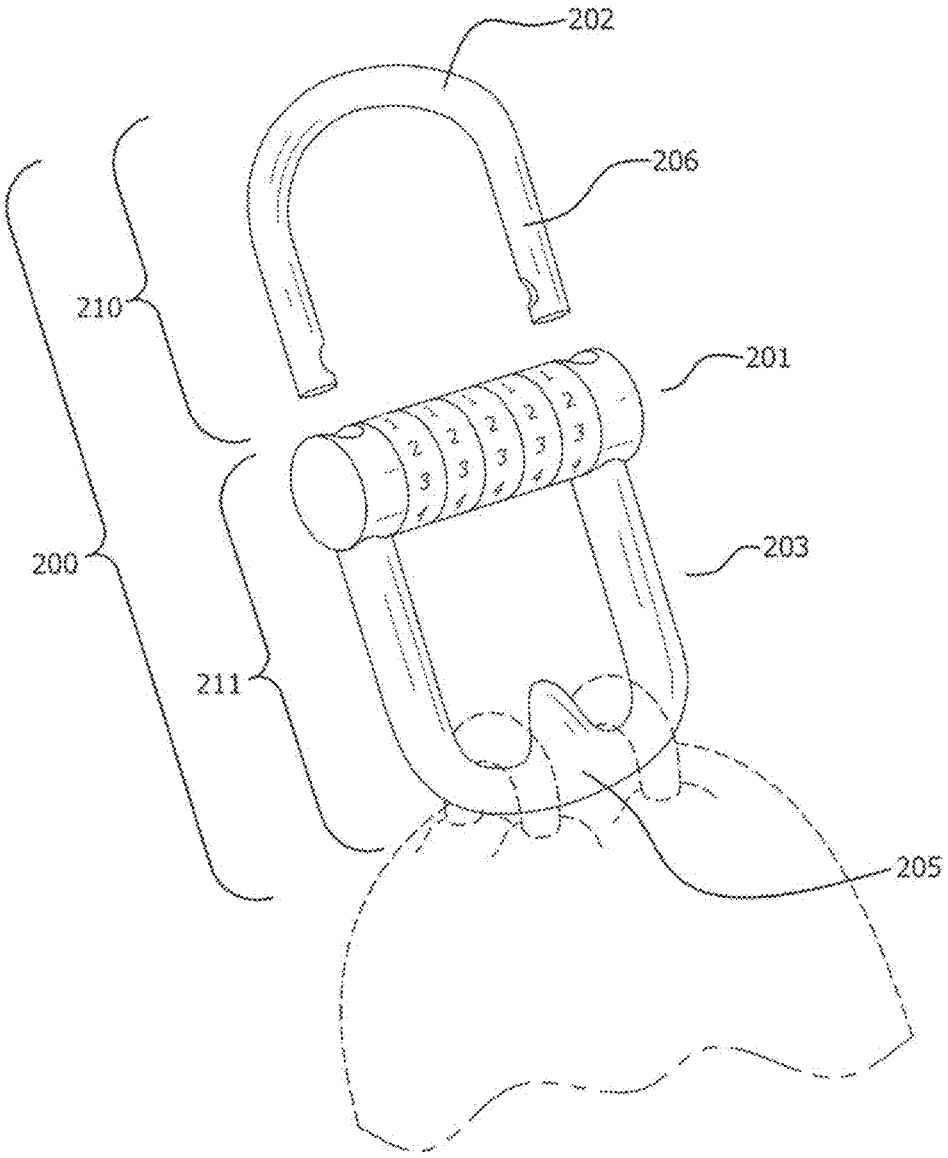
FIG. 6 shows an alternate embodiment of the removable connection device in which the support element is located on an upper portion of the removable connection device, while the locking element and bridge piece are located on a lower portion of the removable connection device.

As shown in the alternate embodiments in FIGS. 5 and 6, removable connection device 200 comprises an upper portion 210 and a lower portion 211 which are reversibly connected together. Removable connection device 200 has a width that permits it to be attached to the narrowest part of a doorknob, knocker, rail, or other protrusion from a door or structure. However, the width of removable connection device 200 is such that, upon connection of upper portion 210 and lower portion 211, it cannot be advanced past the widest portion of the doorknob, knocker, rail, or other protrusion from the door or structure to which it is attached; the only way of advancing the removable connection device 200 past such structure is to disconnect upper portion 210 from lower portion 211.

Removable connection device 200 further comprises locking element 201, support element 202, and bridge piece 203. Locking element 201 may be a keyed lock, combination lock, or any other type of lock known to one skilled in the art, capable of providing for the reversible connection and locking together of upper portion 210 and lower portion 211. Support element 202 allows the invention to be hung on a doorknob or other protrusion from a door or surface, including, but not limited to, door knockers, fences, hand rails, or other rails. Bridge piece 203 provides a point of connection for lower portion 211 and retaining mechanism 103. Bridge piece 203 and retaining mechanism 103 are configured such that, when joined, bridge piece 203 passes through retaining mechanism 103.

Support element 202, locking element 201, and bridge piece 203 are constructed of materials rugged enough to prevent a thief from merely breaking them. In preferred embodiments, they individually or collectively have an exterior finish designed to prevent unnecessary damage or wear to the doorknob or other feature of the structure to which the package receptacle is being attached. In one such embodiment, the support element is covered in a rubberized or otherwise similarly-cushioned material to prevent unnecessary damage or wear to the doorknob or other feature of the structure to which the package receptacle is being attached.

In one embodiment, at least a portion of the removable connection device 200 expected to come in contact with the doorknob or other feature of the structure to which the invention will be attached is covered in a rubberized or otherwise cushioned material. In an alternate embodiment, all portions of the removable connection device 200 expected to come in contact with the doorknob or other feature of the structure are covered in a rubberized or otherwise cushioned material.

In a preferred embodiment, lower portion 211 also has separator portion 205, which forces retaining mechanisms 103 apart from one another. The closer retaining mechanisms 103 are to one another when connected to lower portion 211, the greater the strain on the material of flexible receiving bag 100. Accordingly, with the benefit of the present disclosure, one skilled in the art would be enabled to manufacture the invention with a bridge piece 203 and separator portion 205 of appropriate size to minimize the strain on the material of flexible receiving bag 100.

In one embodiment, as shown in FIG. 5, locking element 201 and support element 202 are located on upper portion 210. In such embodiments, lower portion 211 is generally of a U-shaped construction and further comprises upwardly-extending arms 204 which insert into upper portion 210 and engage with locking element 201 to reversibly connect and lock lower portion 211 and upper portion 210 together.

In an alternate embodiment, as shown in FIG. 6, locking element 201 and bridge piece 203 are located on lower portion 211. In such embodiments, lower portion 211 is general of a D-shaped construction, and upper portion 210 is generally of an upside-down U-shaped construction, with downwardly extending arms 206 which insert into lower portion 211 and engage with locking element 201 to reversibly connect and lock lower portion 211 and upper portion 210 together.

Figure 1:
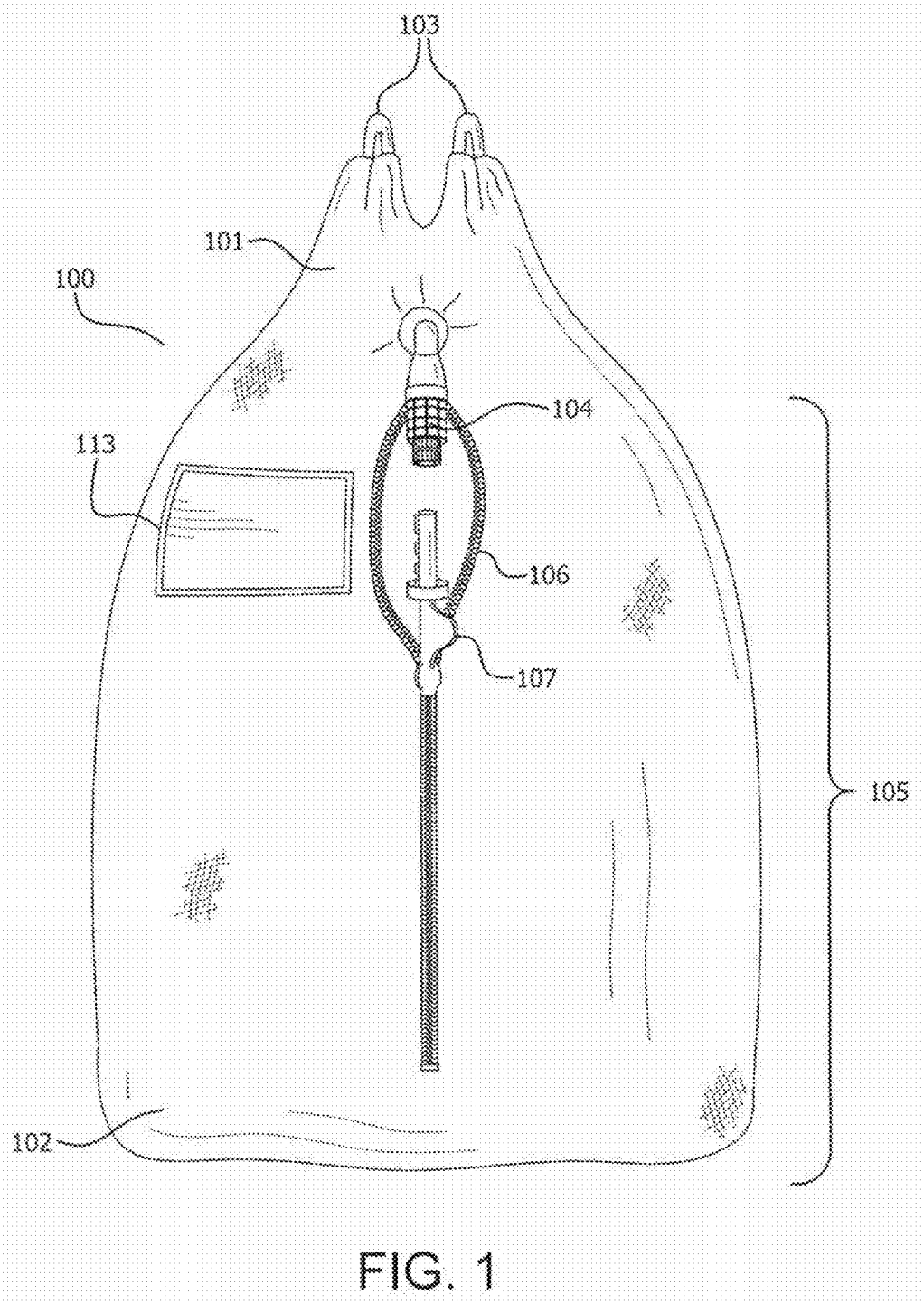
FIGS. 1 and 2 show embodiments of a single-chamber flexible receiving bag.

FIG. 1 shows a preferred embodiment of a flexible receiving bag 100 having a single internal chamber for connection to removable connection device 200. The depicted embodiment has two retaining mechanisms 103, a top end 101, a bottom end 102, an identification pouch 113, a locking receiver 104, and a zipper mechanism 105.

FIG. 1 depicts an embodiment in which locking receiver 104 and zipper mechanism 105 are positioned on the flexible receiving bag beneath and between retaining mechanisms 103; FIG. 2 shows an alternate 2 shows an alternate embodiment of a single-chambered bag in which locking receiver 104 and zipper mechanism 105 are positioned on the flexible bag beneath and to the side of retaining mechanisms 103. However, the present invention is not so limited, and with the benefits of this disclosure, one skilled in the art would be enabled to manufacture a flexible receiving bag in which locking receiver 104 and zipper mechanism were located at any place of the user's choosing on flexible receiving bag 100.

Figure 4:
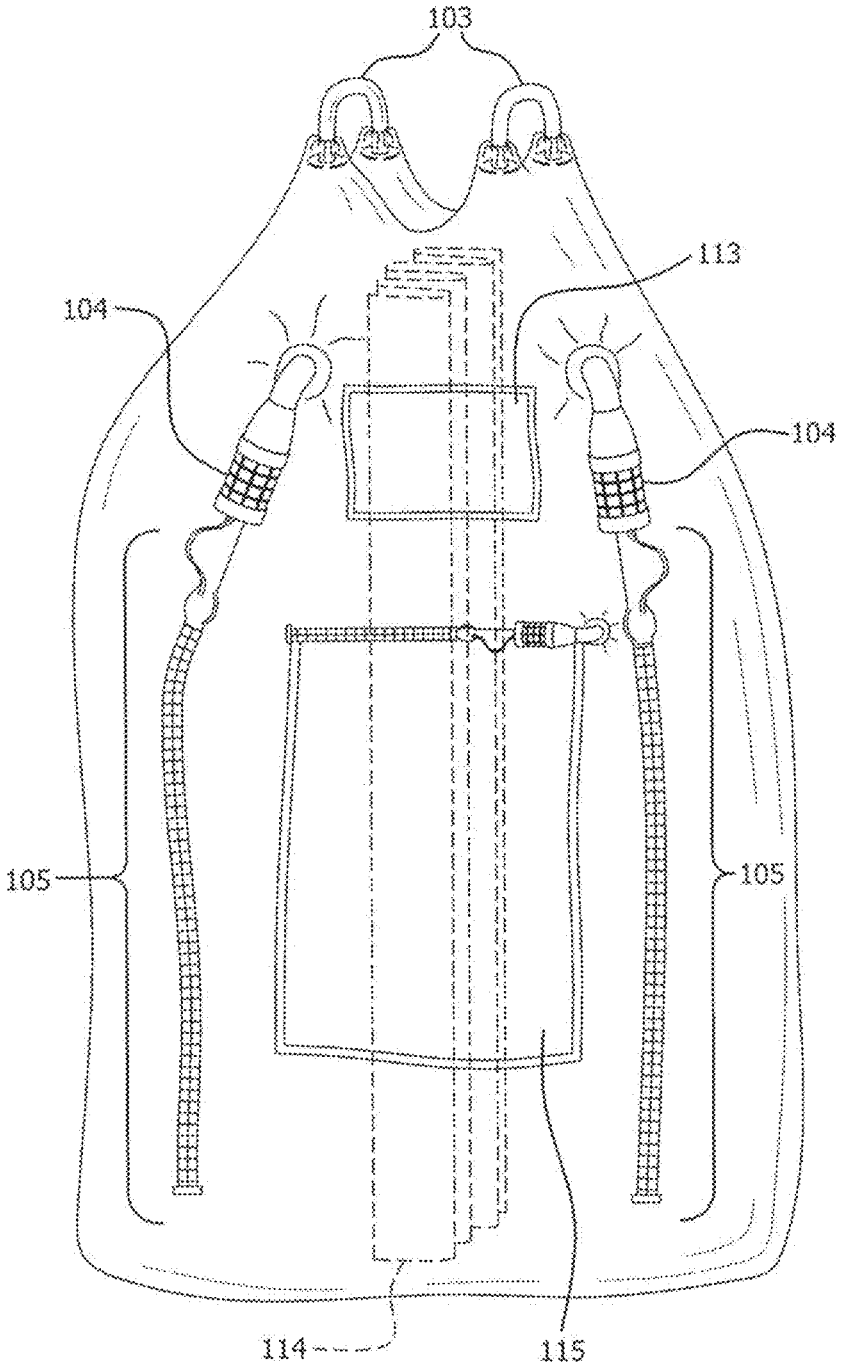
FIG. 4 shows an embodiment of a flexible receiving bag having two interior compartments divided by flexible, yet secure material, multiple attachment mechanisms, an identification pouch, and a locking storage pouch.

FIG. 4 shows a preferred embodiment for a flexible receiving bag 100 having a storage pouch 115 and an identification pouch 113, as well as multiple internal chambers separated by a divider 114, with the storage pouch and each internal chamber having its own respective locking receiver 104 and zipper mechanism 105.

Figure 7:
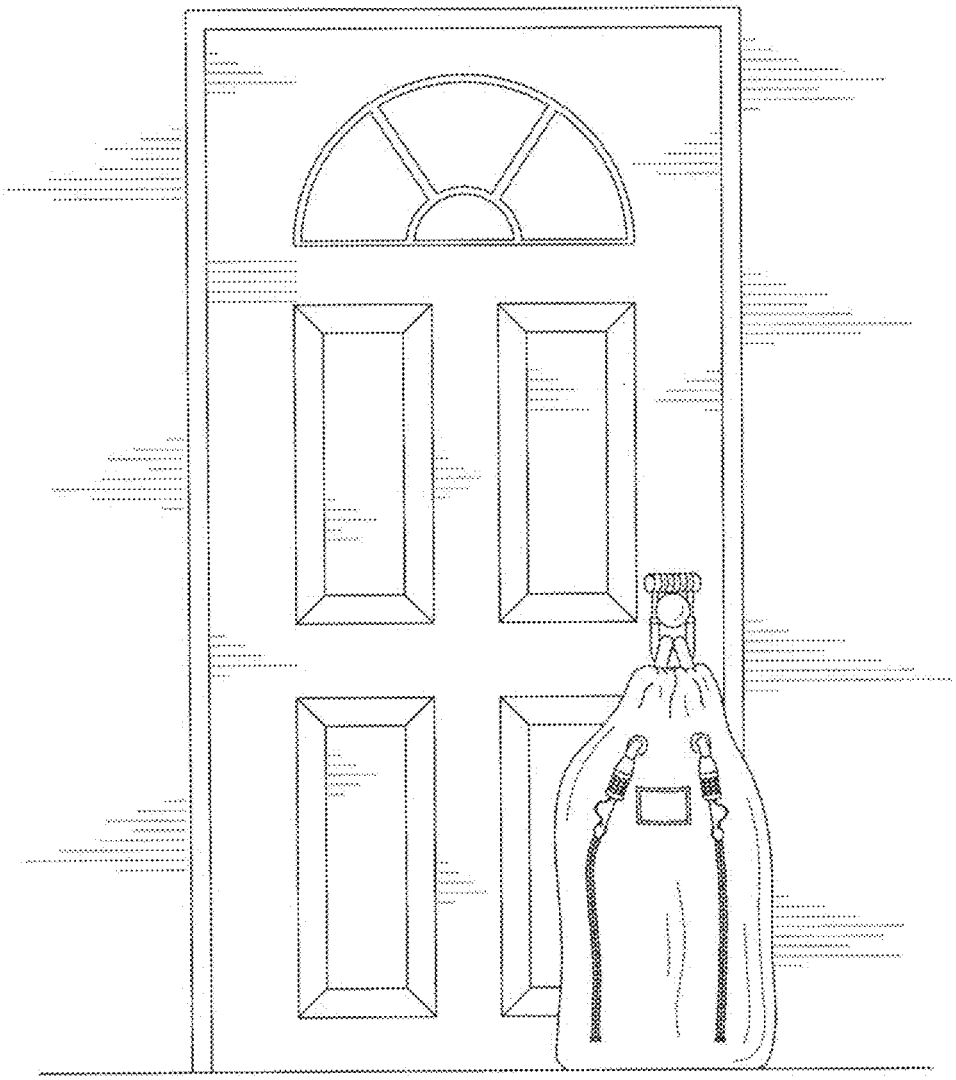
FIG. 7 shows an embodiment of the invention having a removable connection device, in which the invention is removably affixed to a doorknob.

FIG. 7 depicts a flexible receiving bag 100 having two internal chambers being removably attached to a door.

The size of each part of the present invention may be adjusted by one skilled in the art to permit the flexible receiving bag 100 to be suspended above the ground or to have the bottom of the flexible receiving bag 100 rest on the ground; such sizing features permit for easier usage by a postal carrier or delivery person, as they can be tailored to reduce the need to bend over to access the bag as well as maximize the carrier's or delivery person's efficiency in closing the bag by permitting zipping of zipper mechanism 105 and engagement of slider 107 with locking receiver 104 to take place in a single movement or be accomplished by a single hand.

Partial Permanent Attachment Form

In an alternate set of embodiments, at least a portion of the invention permanently attaches to a structure. In such embodiments, the flexible receiving bag further comprises a handle 404 and a connection member 403. In a preferred embodiment, connection member 403 is cone-shaped. In an alternate embodiment, connection member 403 is a ring or rings. Other structures may be suitable shapes for connection member 403 and with the benefit of the present disclosure, one skilled in the art would be enabled to manufacture the invention with a variety of shapes.

Additionally, in such embodiments, the invention further comprises an attachment device 400 comprising a permanent fixture 300, a linkage member 401, and a lock device 402.

Figure 9A:
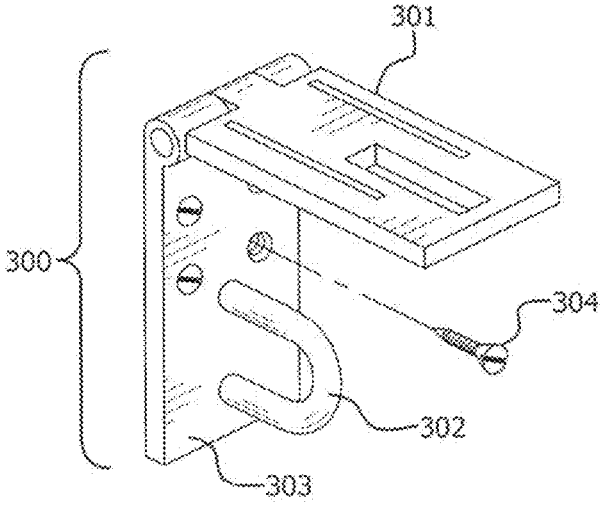
FIGS. 9A-9C shows a detailed view of an embodiment of the attachment device.
Figure 9C:
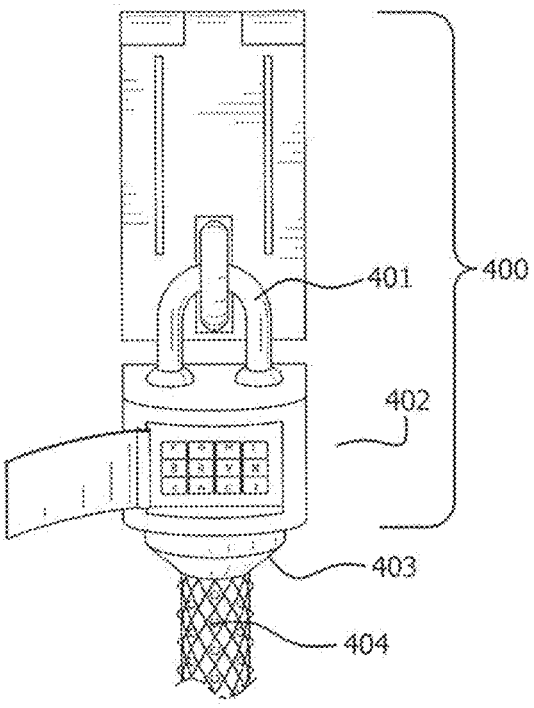
Figure 9B:
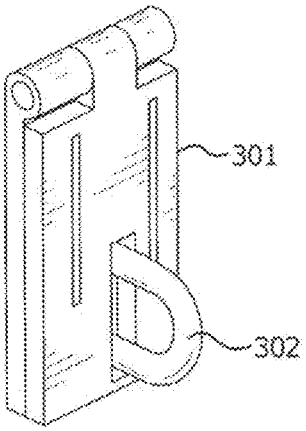

As shown in FIG. 9A, permanent fixture 300 comprises a wall mount 303, a hinge, a hasp 301, and a U-shaped mounting ring 302. Permanent fixture 300 is permanently affixed to the wall or other structure by methods well known to those in the art, including screws 304, bolts, or other methods. Hasp 301 is a generally flat sheet, connected to wall mount 303 via a hinge, and having a slot to permit the U-shaped mounting ring 302 to extend through hasp 301 when hasp 301 is in a closed position, as shown in FIG. 9B. FIG. 9C shows the relationship of attachment device 400 to connection member 403 and handle 404 when connection member 403 is connected to attachment device 400.

Figure 10A:
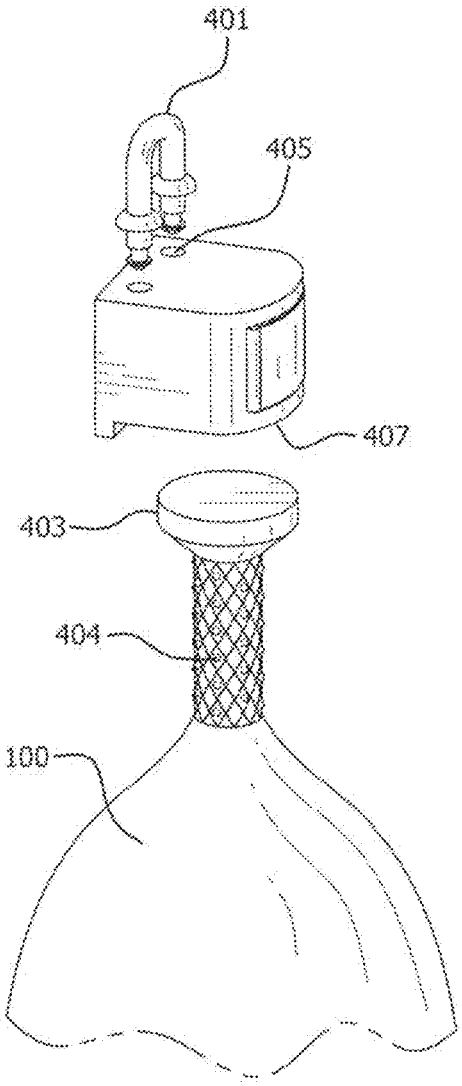
FIGS. 10A-B shows a view of the relationship of the attachment device to the flexible receiving bag.

As seen in FIGS. 9C and 10A, linkage member 401 is a generally U-shaped member having two prongs, and configured to be able to extend through U-shaped mounting ring 302 and to reversibly engage with lock device 402.

Figure 10B:
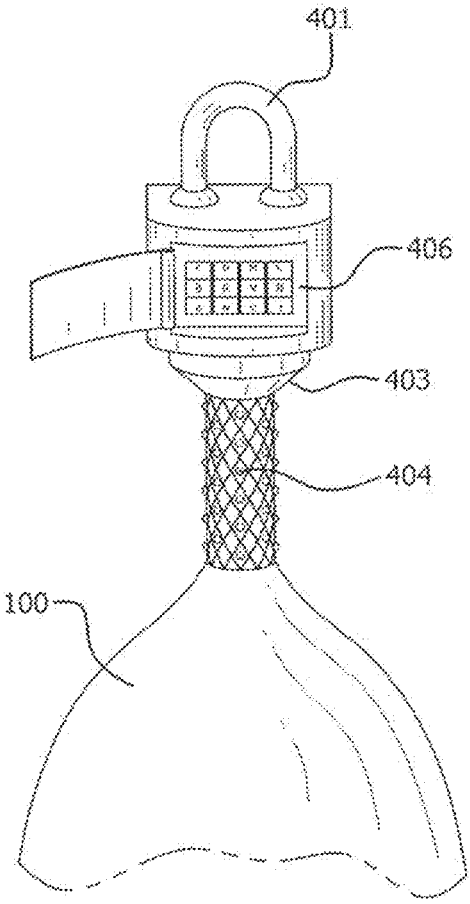

Lock device 402 comprises a housing having receptacles 405 for receiving insertion of the prongs of the linkage member 401, a security mechanism 406, and a receiving port 407 for receiving the insertion of connection member 403. In a preferred embodiment, as shown in FIG. 10A, receptacles 405 are located on a top face of lock device 402 and receiving port 407 is located on a bottom face of lock device 402. FIG. 10B shows such an embodiment, with linkage member 401 and connection member 403 both engaged with security mechanism 406. Security mechanism 406 is one of any locking mechanisms known in the art capable of providing reversible connection and locking of the linkage member 401 to the security mechanism 406 and of connection member 403 to security mechanism 406. Security mechanism 406 may be a keyed lock, combination lock, or any other type of lock known to one skilled in the art. In a preferred embodiment, security mechanism 406 is configured to provide independent release of linkage member 401 the connection member 403, such that a user can elect to release just linkage member 401, just connection member 403, or both.

Figure 8:
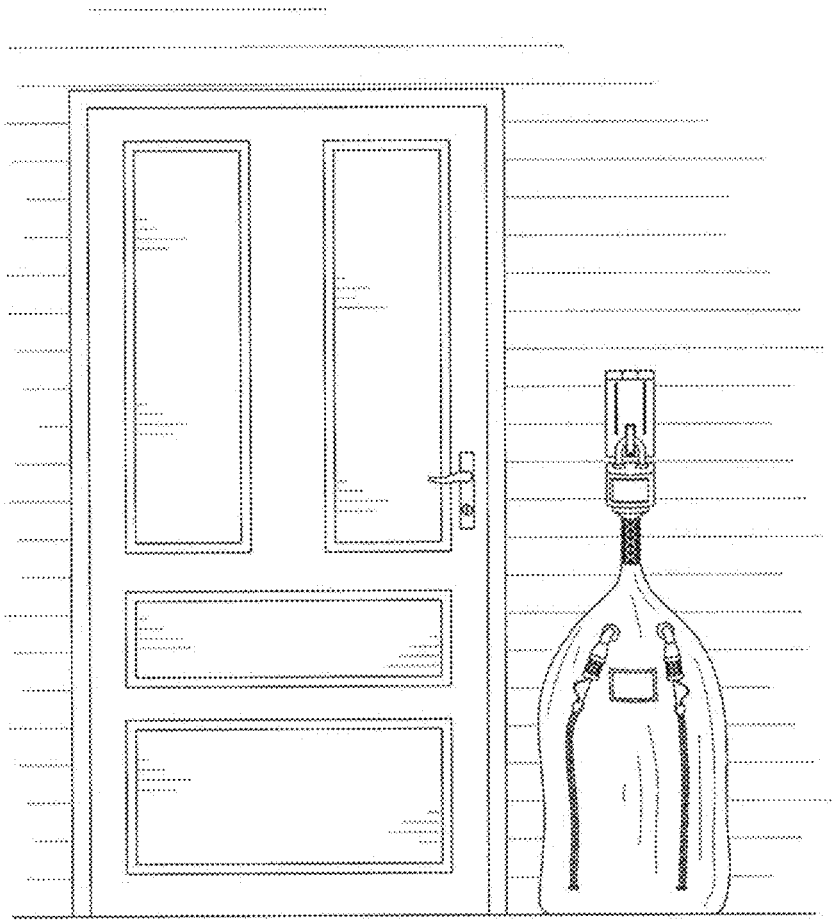
FIG. 8 shows an embodiment of the invention having an attachment device that utilizes a hasp as a permanent fixture to provide an attachment point to a structure.

FIG. 8 depicts an embodiment of the invention in use and attached to a structure.

The size of each part of the present invention may be adjusted by one skilled in the art to permit the flexible receiving bag 100 to be suspended above the ground or to have the bottom of the flexible receiving bag 100 rest on the ground; such sizing features permit for easier usage by a postal carrier or delivery person, as they can be tailored to reduce the need to bend over to access the bag as well as maximize the carrier's or delivery person's efficiency in closing the bag by permitting zipping of zipper mechanism 105 and engagement of slider 107 with locking receiver 104 to take place in a single movement or be accomplished with a single hand.

USE OF THE INVENTION

Fully Removable Form

In one embodiment, a method of use of the invention is as follows: a user unzips zipper mechanism 105 by moving slider 107 from the second end of zipper mechanism 105 to the first end of zipper mechanism 105, in order to provide access to an internal chamber or storage pouches of flexible receiving bag 100. Then the user connects the lower portion 211 of removable connection device 200 to flexible receiving bag 100 via retaining mechanism 103, the user then attaches the invention to a door or other structure by connecting lower portion 211 to upper portion 210 via locking element 201 around a doorknob, knocker, rail, or other similar protrusion from a door or structure, or through an opening in the same. Upon arrival of the postal carrier or delivery person, a package is placed within the internal chamber of flexible receiving bag 100, and the carrier or delivery person then advances the slider 107 from first end of zipper mechanism 105 towards the second end of zipper mechanism 105, upon reaching the second end of zipper mechanism 105, slider 107 is reversibly engaged with locking receiver 104, locking the zipper mechanism 105 into a closed formation. The user may then return to the package receptacle at a convenient time and unlock the locking receiver 104, move the slider 107 from the second end of the zipper mechanism 105 to the first end of the zipper mechanism 105, thereby providing access to the internal chamber, and allowing for retrieval of the package from the package receptacle. The user may then unlock locking element 201 and separate upper portion 210 from lower portion 211, and remove the invention from the door or structure to which it had been attached.

In an alternate embodiment, the user proceeds as above, however, instead of unzipping the zipper mechanism prior to attaching the lower portion 211 to flexible receiving bag 200, the user first attaches lower portion 211 to flexible receiving bag 200, then unzips zipper mechanism 105, and then follows the remaining steps as set forth above.

In yet another embodiment, the user first connects the lower portion 211 to the flexible receiving bag 200, then attaches the invention to the door or structure as described above, and then unzips the zipper mechanism 105. The remaining steps remain unchanged.

In embodiments where the lower portion 211 is permanently affixed to the flexible receiving bag 100, the step of connecting the lower portion 211 to the flexible receiving bag 100 as outlined above may be excised and the remainder of the steps may be undertaken as set forth in each of the examples above.

In a preferred embodiment, the step of the postal carrier or delivery person advancing the slider 107 to the second end of zipper mechanism 105 and reversibly engaging slider 107 and locking receiver 104 is carried out in single motion.

Partial Permanent Attachment Form

In one embodiment, a method of use of the invention is as follows: a user mounts the permanent fixture 300 to a structure, the user then feeds linkage member 410 through u-shaped mounting ring 302. The user inserts the prongs of linkage member 401 into receptacles 405 and then inserts connection member 403 into receiving port 407. User may have unlocked locking receiver 104 and unzipped zipper mechanism 105 at any point prior in the method or may elect to do so at this point. Upon arrival of the postal carrier or delivery person, a package is placed within the internal chamber of flexible receiving bag 100, and the carrier or delivery person then advances the slider 107 from first end of zipper mechanism 105 towards the second end of zipper mechanism 105, upon reaching the second end of zipper mechanism 105, slider 107 is reversibly engaged with locking receiver 104, locking the zipper mechanism 105 into a closed formation. The user may then return to the package receptacle at a convenient time and disconnect the flexible receiving bag 100 from permanent fixture 300 by engaging security mechanism 406 to either disconnect linkage member 401 or connection member 403 from lock device 402. The package may be accessed by unlocking locking receiver 104 and unzipping zipper mechanism 105; this step may be completed prior to, after, or in lieu of disconnecting the flexible receiving bag 100 from permanent fixture 300. For all subsequent uses, the step of mounting permanent fixture 300 to a structure may be skipped.

In an alternate embodiment, the steps of inserting the prongs of linkage member 401 into receptacles 405 and inserting connection members 403 into receiving port 407 are reversed, such that the flexible receiving bag 100 is connected to lock device 402 prior to connecting lock device 402 to permanent fixture 300.

In a preferred embodiment, the step of the postal carrier or delivery person advancing the slider 107 to the second end of zipper mechanism 105 and reversibly engaging slider 107 and locking receiver 104 is carried out in single motion.

The disclosure of each patent, patent application and publication cited or described in this document is hereby incorporated herein by reference, in its entirety.

While the foregoing specification has been described with regard to certain preferred embodiments, and many details have been set forth for the purpose of illustration, it will be apparent to those skilled in the art without departing from the spirit and scope of the invention, that the invention may be subject to various modifications and additional embodiments, and that certain of the details described herein can be varied considerably without departing from the basic principles of the invention. Such modifications and additional embodiments are also intended to fall within the scope of the appended claims.

We claim:

1. A theft-deterring package receptacle comprising:

a flexible receiving bag, the flexible receiving bag comprising a main body that encloses an internal chamber; and an opening in the main body;

a locking receiver fixed to the main body at one end of the opening; and a slider attached to the main body at an other end of the opening; and a fixture for attaching the theft-deterring package receptacle in position;

wherein the main body is formed by a wire mesh;

wherein the slider is switchable between a close state, in which the slide is engaged with the locking receiver and the internal chamber of the main body is not accessible through the opening, and an open state, in which the slider is disengaged with the locking receiver and the internal chamber of the main body is accessible through the opening;

wherein the internal chamber comprises a first chamber and a second chamber divided by a divider, and the opening comprises a first opening for the first chamber and a second opening for the second chamber;

wherein the locking receiver comprises a first locking receiver fixed to the main body at one end of the first opening and a second locking receiver fixed to the main body at one end of the second opening; and wherein the slider comprises a first slider attached to the main body at an other end of the first opening and a second slider attached to the main body at an other end of the second opening;

wherein each of the first and second sliders is switchable between the close state and the open state independent from one another; and wherein the divider has an accordion-like shape with a plurality of folds to permit for expansion of any of the first and second chambers.

2. The theft-deterring package receptacle of claim 1, wherein the wire mesh is formed by a plurality of wires, wherein each wire is linked to an adjacent wire at a plurality of positions.

3. The theft-deterring package receptacle of claim 2, wherein the wires are configured so that the flexible receiving bag is able to be compressed or distorted from a basic shape of the flexible receiving bag.

4. The theft-deterring package receptacle of claim 2, wherein the plurality of wires are linked to each other through ties or by wrapping around one another.

5. The theft-deterring package receptacle of claim 2, wherein the wire mesh is sandwiched between a first and a second layers of fabric.

6. The theft-deterring package receptacle of claim 5, wherein the fabric is waterproof.

7. The theft-deterring package receptacle of claim 5, wherein the fabric is one selected from the group consisting of canvas, nylon, and leather.

8. The theft-deterring package receptacle of claim 7, wherein the locking receiver is configured to engage with at least a portion of the slider by insertion of the portion of the slider into the locking receiver.

9. The theft-deterring package receptacle of claim 8, wherein the portion of the slider further comprises a keyed element for engagement by the locking receiver.

10. The theft-deterring package receptacle of claim 1, wherein the locking receiver comprises a locking element, and wherein in the close state, at least a portion of the slider is engaged directly with the locking element.

11. The theft-deterring package receptacle of claim 10, wherein the locking element is configured to lock and unlock the locking receiver and the slider through a key or a combination.

12. The theft-deterring package receptacle of claim 1, wherein the locking receiver further comprises an attachment element that extends into the flexible receiving bag and terminates at an anchor element which prevents the locking receiver from being removed from the flexible receiving bag.

13. The theft-deterring package receptacle of claim 12, wherein the anchor element is formed as a ball or a ring.

14. The theft-deterring package receptacle of claim 1, wherein the flexible receiving bag further comprises two complementary, reversibly engageable teeth elements fixed to the opening; and wherein the slider engages the two teeth elements with one another when moving from the other end to the one end of the opening, and disengage the two teeth elements from one another when moving from the one end to the other end of the opening.

15. The theft-deterring package receptacle of claim 14, wherein the slider further comprises a pull to be operated by a user.

16. The theft-deterring package receptacle of claim 14, wherein the locking receiver is located proximal to a top end of the opening, and the slider is located proximal to a bottom end of the opening in the open state.

17. The theft-deterring package receptacle of claim 1, further comprises a storage pouch that is provided to the outer side of the flexible receiving bag.

18. The theft-deterring package receptacle of claim 1, further comprises an identification pouch to present identification information.

* * * * *